US007337856B2

(12) United States Patent
Lund et al.

(10) Patent No.: US 7,337,856 B2
(45) Date of Patent: Mar. 4, 2008

(54) METHOD AND APPARATUS FOR SUPPRESSION OF FIRES

(75) Inventors: Gary K. Lund, Malad, ID (US); James D. Rozanski, Brigham City, UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 10/727,093

(22) Filed: Dec. 2, 2003

(65) Prior Publication Data

US 2005/0115722 A1 Jun. 2, 2005

(51) Int. Cl.

| | |
|---|---|
| ***A62C 35/00*** | (2006.01) |
| ***A62C 37/36*** | (2006.01) |
| ***A62C 2/00*** | (2006.01) |
| ***E03C 1/08*** | (2006.01) |
| ***B05B 7/10*** | (2006.01) |
| ***F23D 11/16*** | (2006.01) |

(52) U.S. Cl. ..... 169/6; 169/42; 169/43; 169/44; 169/45; 169/46; 239/428.5; 239/398; 239/399; 239/419.5; 239/429; 239/432

(58) Field of Classification Search ..... 169/44, 169/43, 45, 46, 42, 6; 239/428.5, 398, 399, 239/406, 419.5, 429, 432, 128
See application file for complete search history.

(56) References Cited

U.S. PATENT DOCUMENTS 1,839,658 A 1/1932 Dugas
2,744,816 A 5/1956 Hutchison
2,841,227 A 7/1958 Betzler
3,255,824 A 6/1966 Rodgers
3,524,506 A 8/1970 Weise
3,641,935 A 2/1972 Gawlick et al.

(Continued)

FOREIGN PATENT DOCUMENTS

DE 195 46 528 A1 6/1997

(Continued)

OTHER PUBLICATIONS

Annex to Form PCT/ISA/206, Communication Relating to the Results of the Partial International Search, mailed Jun. 24, 2005.

(Continued)

*Primary Examiner*—Davis Hwu
(74) *Attorney, Agent, or Firm*—TraskBritt

(57) ABSTRACT

An apparatus, system and method for suppression of fires are provided. In accordance with one embodiment of the invention, a housing is provided with a first opening (or set of openings), a second opening (or set of openings) and a flow path defined between the first and second openings. A fire-suppressing gas is produced, such as from a solid propellant composition, and is introduced into the flow path in such a way that a volume of ambient air is drawn from a location external to the housing, through the first opening and into the flow path. The volume of ambient air may be subjected to an oxygen-reducing process and mixed with the fire-suppressing gas to form a gas mixture. The gas mixture is discharged from the flow path through the second opening and into an associated environment for suppression of a fire located therein.

87 Claims, 9 Drawing Sheets

U.S. PATENT DOCUMENTS 3,741,585 A 6/1973 Hendrickson et al.
3,806,461 A 4/1974 Hendrickson et al.
3,972,545 A 8/1976 Kirchoff et al.
3,972,820 A 8/1976 Filter et al.
4,064,944 A 12/1977 McClure et al.
4,067,392 A * 1/1978 Rich ..... 169/47
4,113,019 A 9/1978 Sobolev et al.
4,224,994 A 9/1980 Tone et al.
4,448,577 A 5/1984 Paczkowski
4,505,336 A 3/1985 Thevis et al.
4,601,344 A 7/1986 Reed, Jr. et al.
4,807,706 A 2/1989 Lambertsen et al.
4,909,549 A 3/1990 Poole et al.
4,931,111 A 6/1990 Poole et al.
5,035,757 A 7/1991 Poole
5,038,866 A 8/1991 Kern et al.
5,060,867 A * 10/1991 Luxton et al. ..... 239/428.5
5,423,384 A 6/1995 Galbraith et al.
5,425,886 A 6/1995 Smith
5,429,691 A 7/1995 Hinshaw et al.
5,439,537 A 8/1995 Hinshaw et al.
5,441,114 A 8/1995 Spector et al.
5,449,041 A 9/1995 Galbraith
5,495,893 A 3/1996 Roberts et al.
5,520,826 A 5/1996 Reed, Jr. et al.
5,531,941 A 7/1996 Poole
5,538,568 A 7/1996 Taylor et al.
5,588,493 A 12/1996 Spector et al.
5,609,210 A 3/1997 Galbraith et al.
5,610,359 A 3/1997 Spector et al.
5,613,562 A 3/1997 Galbraith et al.
5,739,460 A 4/1998 Knowlton et al.
5,762,145 A 6/1998 Bennett
5,783,773 A 7/1998 Poole
5,820,160 A * 10/1998 Johnson et al. ..... 280/736
5,845,716 A 12/1998 Birk
5,845,933 A 12/1998 Walker et al.
5,861,106 A 1/1999 Olander
5,865,257 A 2/1999 Kozyrev et al.
5,876,062 A 3/1999 Hock
5,882,036 A 3/1999 Moore et al.
5,884,710 A 3/1999 Barnes et al.
5,918,679 A 7/1999 Cramer
5,957,210 A 9/1999 Cohrt et al.
5,985,060 A 11/1999 Cabrera et al.
5,992,528 A 11/1999 Parkinson et al.
5,992,530 A 11/1999 Sundholm
5,996,699 A 12/1999 Sundholm
6,012,533 A 1/2000 Cramer
6,016,874 A 1/2000 Bennett
6,019,177 A 2/2000 Olander
6,019,861 A 2/2000 Canterberry et al.
6,024,889 A 2/2000 Holland et al.
6,039,820 A 3/2000 Hinshaw et al.
6,045,637 A 4/2000 Grzyll
6,045,638 A * 4/2000 Lundstrom ..... 149/36
6,065,774 A 5/2000 Cabrera
6,076,468 A 6/2000 DiGiacomo et al.
6,086,693 A 7/2000 Mendenhall et al.
6,089,326 A 7/2000 Drakin
6,093,269 A 7/2000 Lundstrom et al.
6,096,147 A 8/2000 Taylor et al.
6,116,348 A 9/2000 Drakin
6,123,359 A 9/2000 Cabrera et al.
6,132,480 A 10/2000 Barnes et al.
6,136,114 A 10/2000 Johnson et al.
6,202,755 B1 3/2001 Hardge
6,217,788 B1 4/2001 Wucherer et al.
6,224,099 B1 5/2001 Nielson et al.
6,250,072 B1 6/2001 Jacobson et al.
6,257,341 B1 7/2001 Bennett
6,287,400 B1 9/2001 Burns et al.
6,314,754 B1 * 11/2001 Kotliar ..... 62/640
6,328,906 B1 12/2001 Lundstrom et al.
6,334,315 B1 1/2002 Kotliar
6,371,384 B1 * 4/2002 Garcia ..... 239/10
6,401,487 B1 6/2002 Kotliar
6,418,752 B2 7/2002 Kotliar
6,435,552 B1 8/2002 Lundstrom et al.
6,474,684 B1 11/2002 Ludwig et al.
6,481,746 B1 11/2002 Hinshaw et al.
6,502,421 B2 1/2003 Kotliar
6,513,602 B1 2/2003 Lewis et al.
6,557,374 B2 5/2003 Kotliar
6,560,991 B1 5/2003 Kotliar
6,599,380 B2 7/2003 Zeuner et al.
6,601,653 B2 8/2003 Grabow et al.
6,605,233 B2 8/2003 Knowlton et al.
6,612,243 B1 * 9/2003 Italiane et al. ..... 102/367
6,634,433 B2 10/2003 Kim et al.
6,739,399 B2 5/2004 Wagner et al.
6,851,483 B2 2/2005 Olander et al.
6,942,249 B2 9/2005 Iwai et al.
7,156,184 B2 1/2007 Wagner
2002/0007886 A1 1/2002 Neidert et al.
2002/0020536 A1 2/2002 Bennett
2002/0137875 A1 9/2002 Reed et al.
2004/0089460 A1 5/2004 Richardson
2005/0115721 A1 6/2005 Blau et al.
2005/0139365 A1 6/2005 Richardson et al.
2005/0189123 A1 9/2005 Richardson et al.
2005/0257866 A1 11/2005 Williams et al.

FOREIGN PATENT DOCUMENTS

DE 197 17 044 A1 10/1997
EP 0956883 A1 11/1999
GB 1 219 363 A 1/1971
WO WO93/15793 8/1993
WO 0006424 A1 2/2000
WO WO 03/024534 A1 3/2003
WO WO 2004/028642 A1 4/2004

OTHER PUBLICATIONS

PCT International Search Report dated Mar. 17, 2005.

PCT International Preliminary Examination Report, dated Jan. 17, 2005.

"Water Mist-Fire-Suppression Experiment," NASA Glenn Research Center, Dec. 2001, 3 pages.

Fletcher M., "Fighting Fire with Fire," Eureka (Inc. Engineering Materials and Design), Findlay Publications, Horton Kirby, Kent, GB vol. 20, No. 1, Jan. 2000, p. 17, XP000877927, ISSN: 0261-2097 (Downloaded online version).

U.S. Appl. No. 60/414,157, filed Sep. 28, 2002, to Joseph Michael Bennett, entitled, "In-Room Gas Generator Fire Protection System. ".

PCT International Search Report mailed Nov. 23, 2006.

Ebeling, Hans, et al., "Development of Gas Generators for Fire Extinguishing," Propellants, Explosives, Pyrotechnics, vol. 22, pp. 170-175, 1997.

Engelen, K., et al., "Pyrotechnic Propellant for Nitrogen Gas Generator," Bull. Soc. Chim Belg., vol. 106, No. 6, pp. 349-354, 1997.

Fallis, Stephen, et al., "Advanced Propellant/Additive Development for Fire Suppressing Gas Generators: Development + Test," Proceedings of HOTWC-2002 12th Halon Options Technical Working Conference, Albuquerque, NM, Apr. 20-May 2, 2002, National Institute of Standards and Technology Special Publication 984.

Mitchell, Robert M., Olin Aerospace Company, Report on Advanced Fire Suppression Technology (AFST) Research and Development Program, 52 pages, Report Date Sep. 1994.

Palaszewski, Bryan A., NASA Glenn Research Center, Safer Aircraft Possible with Nitrogen Generation, 2 pages, Mar. 2001.
Saito, Naoshi, et al., "Flame-extinguishing Concentrations and Peak Concentrations of N2, Ar, Co2 and their Mixtures for Hydrocarbon Fuels," Fire Safety Journal, vol. 27, pp. 185-200, 1996.
Schmid, Helmut, et al., "Gas Generator Development for Fire Protection Purpose," Propellants, Explosives, Pyrotechnics, vol. 24, pp. 144-148, 1999.
TNO Defence, Security and Safety, "Solid Propellant Cool Gas Generators," 2 pages, unknown publication date.
Yang, Jiann C., et al., " Solid Propellant Gas Generators: An Overview and Their Application to Fire Suppression," International Conference on Fire Research and Engineering, Sep. 10-15, 1995, Orlando, FL, 3 pages.

* cited by examiner

METHOD AND APPARATUS FOR SUPPRESSION OF FIRES

CROSS-REFERENCE TO RELATED APPLICATIONS

The present application is related to copending U.S. patent application Ser. No. 10/727,088 entitled MAN-RATED FIRE SUPPRESSION SYSTEM, filed on even date herewith and assigned to the Assignee of the present application, the disclosure of which is incorporated by reference herein in its entirety.

BACKGROUND OF THE INVENTION

1. Field of the Invention

The present invention relates generally to the suppression of fires and, more particularly, to methods and apparatus for suppressing fires including the suppression of fires within human-occupied spaces and clean room-type environments.

2. State of the Art

Fire suppression systems may be employed in various situations and locations in an effort to quickly extinguish the undesirable outbreak of a fire and thereby prevent, or at least minimize, the damage caused by such a fire including damage to a building, various types of equipment, as well as injury or loss of human life. A conventional fire suppression system or apparatus may conventionally include a distribution apparatus, such as one or more nozzles, that deploys a fire-suppressing substance upon actuation of the system. Actuation of the system may be accomplished through means of a fire or smoke detection apparatus that is operatively coupled to the suppression system, through the triggering of a fire alarm, or through manual deployment. Various types of fire-suppressing substances or compositions may be utilized depending, for example, on where the fire suppression system or apparatus is being employed, how large of an area is to be serviced by the fire suppression system, and what type of fire is expected to be encountered and suppressed by the system.

For example, in some commercial and even residential fire suppression systems, a network of sprinklers is employed throughout the associated building and configured to distribute water or some other fire-suppressing liquid to specified locations within the building upon activation of the system.

However, a system providing a liquid fire suppressant is not suited for all situations. For example, it would not be generally desirable to employ a fire suppression system utilizing water as the suppressant in a location where grease would likely serve as fuel for an ignited fire at the given location. Similarly, it would not be generally desirable to utilize a liquid suppressant in a location which contained electrical equipment including, for example, costly and sensitive electronic or computer equipment. While a liquid suppressant might adequately suppress a fire in such a location, the suppressant would likely impose substantial damage to the equipment housed therein. Further, a liquid suppressant is not ideally suited for use in a clean room environment where the introduction of a liquid material to the clean room would result in contamination of some article of manufacture (e.g., an integrated circuit device).

Other available suppressants include dry chemical suppressants such as, for example, sodium bicarbonate, potassium bicarbonate, ammonium phosphate, and potassium chloride. While such suppressants can be effective in specific implementations, it is often difficult to implement systems which effectively utilize dry chemicals in large areas. Furthermore, use of dry chemicals can pose a health hazard to individuals in the vicinity of their deployment, as well as act as a source of contamination of electronic and computer equipment or even goods being manufactured, for example, in a clean room. Thus, such suppression systems are not conventionally utilized in locations such as clean rooms, computer rooms or spaces designed for human occupation.

Another type of suppressant which has been used includes gas suppressants. For example, gases designated generally as Halons have been effectively used as fire suppressants in the past. Halons include a class of brominated fluorocarbons derived from saturated hydrocarbons wherein the hydrogen atoms are essentially replaced with atoms of the halogen elements bromine, chlorine and/or fluorine. Halons, including the widely used varieties designated as Halon 1211, 1301 and 2402, have been used for the effective suppression of fires in various environments and situations including human-occupied and clean room-type environments. However, in recent years, an effort to phase out Halons has been undertaken due to their ozone depletion characteristics. Indeed, in the year 1994, production ceased of certain Halons, while others are scheduled to be phased out by the year 2010.

Some of the gases which have been used in an attempt to replace the effective Halon gases include, for example, nitrogen and carbon dioxide. Such gases essentially displace the oxygen contained within the air at the location of the fire such that an insufficient amount of oxygen is available for further combustion. However, such gases generally require the distribution of relatively large volumes of the selected gas in order to be effective as a fire suppressant. In order to accommodate such large volumes of gas, expensive and bulky pressure vessels are conventionally required to store the gas in a compressed state in anticipation of its use. Furthermore, such gases sometimes include or produce byproducts which may be harmful to any equipment or individuals located in the area into which the gas suppressant is distributed.

Additionally, as noted above, the requirements of storing gas, conventionally at high pressures and in large volumes, often make such systems expensive and cumbersome in size in that the systems require a significant amount of space available for installation and operation. In order to address some of the concerns listed above, including the ability to provide adequate volumes of suppressant while requiring relatively small storage facilities, various attempts have been made to develop alternative fire suppression systems.

Some of the approaches to provide alternative fire suppression systems include those disclosed by U.S. Pat. No. 6,257,341 to Bennett, U.S. Pat. No. 5,609,210 to Galbraith et al., and U.S. Pat. No. 6,401,487 to Kotliar. The Bennett Patent generally discloses a system which utilizes a combination of compressed inert gas and a solid propellant gas generator. Upon ignition, the solid propellant gas generator generates nitrogen, carbon dioxide, or a mixture thereof. The gas generated from the solid propellant is then mixed and blended with the stored compressed inert gas, which may include argon, carbon dioxide or a mixture thereof, to provide a resulting blended gas mixture for use as a suppressant. The Bennett system claims to provide a system which is smaller in size than prior art systems and, therefore, is more flexible in its installation in various environments. However, due to the fact that the Bennett system utilizes compressed inert gas, appropriate pressure vessels are required which, as discussed above, are conventionally expensive and require a substantial amount of space for their installation, particularly if a large room or area is being serviced by the described system, therefore requiring a large volume of suppressant.

The above-referenced Galbraith patent generally discloses, in one embodiment, a system which includes a gas generator charged with a combustive propellant wherein the propellant, upon ignition, generates a volume of gas. The generated gas is directed to a chamber containing a volume of packed powder such as magnesium carbonate. The gas drives the powder from the chamber for distribution of the powder onto a fire. In another embodiment, Galbraith discloses a system wherein the generated gas is used to vaporize a liquid, thereby generating a second gas, wherein the second gas is used as the fire suppressant. However, the use of powders, as noted above, is not desirable in, for example, areas which are intended for regular human occupancy, areas intended to house sensitive electronic equipment, or other clean room-type environments. The use of vaporizable liquids may introduce additional issues regarding long-term storage of the liquid including the prevention of possible corrosion of the associated storage container.

The above-referenced Kotliar patent generally discloses a system that includes a hypoxic generator configured to lower the oxygen content of the air contained within a room or other generally enclosed space to a level of approximately 12% to 17% oxygen. One of the embodiments disclosed by Kotliar includes a compressor having an inlet configured to receive a volume of ambient air from the room or enclosure. The compressed air is passed through a chiller or cooler and then through one or more molecular sieve beds. The molecular sieve bed may include a material containing zeolites that allows oxygen to pass through while adsorbing other gases. The oxygen that passes through the molecular sieve bed is discharged to a location external from the room or enclosure being protected. The molecular sieve bed is then depressurized such that the gases captured thereby are released back into the room as an oxygen-depleted gas.

While Kotliar discloses that the system may be used as a fire suppressant system, it is not apparent how efficient the system is in rapidly reducing the oxygen level for a given room so as to suppress any fire therein. Moreover, it appears that the Kotliar system is contemplated as being more effective as a fire prevention system wherein the hypoxic generator is continuously running such that the air within a room or other enclosure is continuously maintained at an oxygen-depleted level in order to prevent ignition and combustion of a fuel source in the first place. However, such an operation obviously requires the constant operation of a hypoxic generator and, thus, likely requires additional upkeep and maintenance of the system. Furthermore, while Kotliar asserts that there are no associated health risks to those who spend an extended amount of time in a hypoxic environment (i.e., an oxygen reduced or depleted environment), such a system may not be ideal for those with existing health conditions, including, for example, respiratory ailments such as asthma or bronchitis or cardiovascular conditions, or for individuals who are elderly or who generally lead an inactive lifestyle.

In view of the shortcomings in the art, it would be advantageous to provide a method, apparatus and system for suppressing fires that provide effective and efficient suppression of a fire within a given location while utilizing a suppressant that is not ozone-depleting yet is fit for use in rooms that are intended for human occupation or that house sensitive components and equipment. It would further be advantageous to provide such a method, apparatus and system that may be adapted for use in numerous locations and in a variety of applications without the need to utilize bulky and expensive storage equipment such as that associated with the storage of compressed gas or other liquid suppressants.

BRIEF SUMMARY OF THE INVENTION

In accordance with one aspect of the invention, a fire suppression apparatus is provided. The apparatus includes a housing defining a first opening therein, a second opening therein and a flow path providing fluid communication between the first opening and the second opening. The apparatus further includes a gas-generating device located and configured to provide a flow of a gas into the flow path such that the flow of the gas draws a volume of ambient air from a location outside the housing, through the first opening and into the flow path.

In accordance with another aspect of the present invention, another fire suppression apparatus is provided. The fire suppression apparatus includes a housing defining a first opening therein, a second opening therein and a flow path providing fluid communication between the first opening and the second opening. A gas-generating device having a solid propellant composition disposed therein is configured such that, upon combustion of the solid propellant, a first gas is produced which may be introduced into the flow path. An igniting device is configured to ignite the solid propellant composition for production of the gas. A nozzle is coupled with the gas-generating device and is located and configured such that the first gas flows through the nozzle into the flow path and also draws a volume of ambient air from a location external to the housing through the first opening and into the flow path. A filter is disposed between the solid propellant composition and the nozzle. A diffuser is disposed within the flow path located and configured to alter a velocity of the first gas and to also effect mixing of the first gas with the volume of ambient air drawn into the flow path and thereby form a gas mixture. At least one conditioning apparatus is disposed within the flow path for conditioning the first gas, the volume of ambient air, or the resulting mixture thereof.

In accordance with yet another aspect of the present invention, a fire suppression system is provided. The fire suppression system includes at least one fire suppression apparatus including, for example, a fire suppression apparatus as provided in accordance with one of the aspects of the present invention. The fire suppression system further includes a controller configured to generate a signal and transmit the signal to the at least one fire suppression apparatus upon the occurrence of a specified event, wherein the at least one fire suppression apparatus is actuated upon receipt of the signal.

In accordance with a further aspect of the present invention, a method is provided for suppressing fires. The method includes providing a housing with a first opening and a second opening. A flow path is defined between the first opening and the second opening. A fire-suppressing gas is produced and introduced into the flow path. A volume of ambient air is aspirated from a location external of the housing through the first opening and into the flow path. Such aspiration may be accomplished by controlling the introduction of the fire-suppressing gas into the flow path including, for example, the location of introduction within the flow path and the velocity of the gas as it is introduced into the flow path. The volume of ambient air is mixed with the fire-suppressing gas to produce a gas mixture and the gas mixture is discharged through the second opening.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
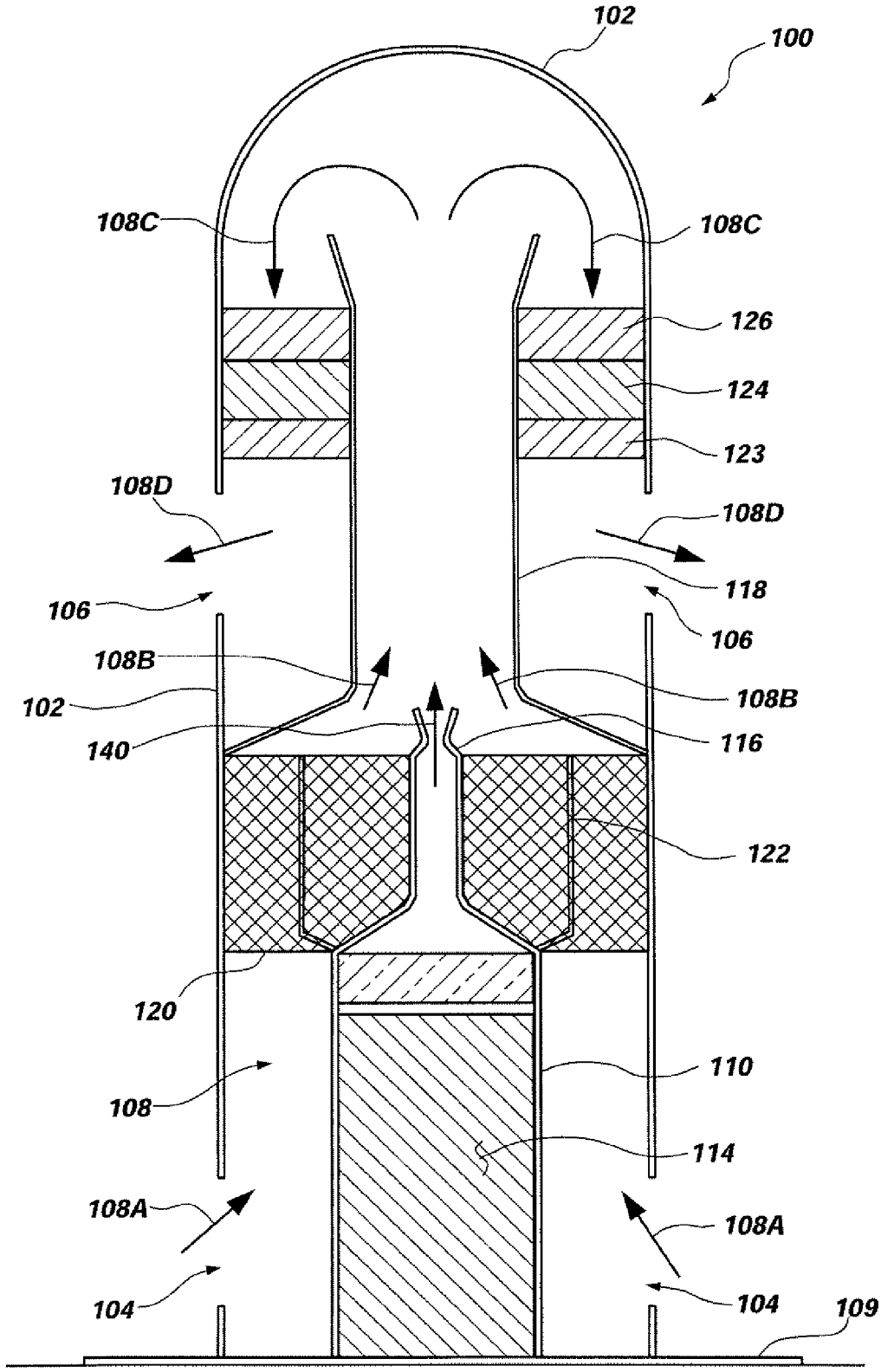
FIG. 1 is a partial cross-sectional view of a fire suppression apparatus in accordance with an embodiment of the present invention.

Referring to FIG. 1, a fire suppression apparatus 100 may include a housing 102 formed of a high-temperature-resistant material such as, for example, steel. A first set of openings 104 and a second set of openings 106 are formed within the housing 102. A flow path 108 is defined between the first and second sets of openings 104 and 106, respectively, providing substantial fluid communication therebetween. A mounting structure 109, such as, for example, a flange, may be coupled to or formed with the housing 102 such that the fire suppression apparatus 100 may be fixedly mounted to a structure within a selected environment.

A gas-generating device 110 may be disposed at one end of the housing 102 and may contain a propellant 114, such as a solid propellant which is configured to generate a desired gas upon ignition and combustion thereof as described in further detail below. The gas-generating device 110 may be coupled to a nozzle 116 for dispersion of any gas flowing out of the gas-generating device 110. As will be appreciated by those of ordinary skill in the art, through proper configuration of the nozzle 116, the pressure and/or velocity of the gas exiting the gas-generating device 110 via the nozzle 116 may be controlled with considerable accuracy.

The nozzle 116 may be configured to discharge any generated gas into a diffuser 118 or other flow control device positioned within the flow path 108 and to promote an expansion of the discharged gas, thereby reducing the velocity and temperature of the gas. Furthermore, as will be further discussed below, the diffuser 118 may be configured to promote the mixing of gas discharged from the nozzle 116 with a volume of ambient air flowing through the first set of openings 104 into the flow path 108.

Downstream from the first set of openings 104 within the flow path 108 is an oxygen-getting device 120 configured to remove oxygen from any air flowing through the first set of openings 104 and through the associated flow path 108. The oxygen-getting device 120 may be formed of an oxygen reactive material such as, for example, steel, copper, zirconium, iron, nickel or titanium. The material may be configured as, for example, wool, cloth, mesh or shot so that the material may be packed or otherwise distributed within the flow path 108 while also enabling gas to travel therethrough. As shown in FIG. 1, it may be desirable for the oxygen-getting device 120 to be disposed adjacent the nozzle 116 and thermally coupled therewith. For example, a plurality of thermally conductive fins 122 or other heat transfer features may be used to transfer heat produced from the gas-generating device 110 to the oxygen-getting device 120.

Other processing or conditioning devices may be placed in the flow path 108 and located downstream of the first oxygen-getting device 120. For example, a second oxygen-getting device 123 may be used to further reduce the level of oxygen from any air flowing through the flow path 108 depending on, for example, the efficiency of the first oxygen-getting device 120 and the desired oxygen content of any gas leaving the flow path 108 through the second set of openings 106. Additionally, an $NO_x$ scavenging device 124 may be utilized to remove nitric oxide from gases flowing through the flow path 108 which may be present, for example, depending on the composition of the solid propellant 114 and the gas produced thereby. Alternatively, or additionally, a $NH_3$ scavenging device may be used to remove ammonia from gases flowing through the flow path 108.

A heat transfer device 126 may also be located within the flow path 108 and configured to lower the temperature of any gas flowing therethrough prior to the gas exiting the second set of openings 106. The heat transfer device 126 may exhibit a relatively simple configuration including, for example, thermally conductive fins, tubes or shot, configured to allow gas to flow therethrough (or thereover) and transfer heat away from the gas. In another embodiment, the heat transfer device 126 may exhibit a more complex configuration including, for example, a phase change material or a mechanical heat exchanger employing a circulating fluid medium to transfer heat away from any gas flowing through the flow path 108.

Figure 2:
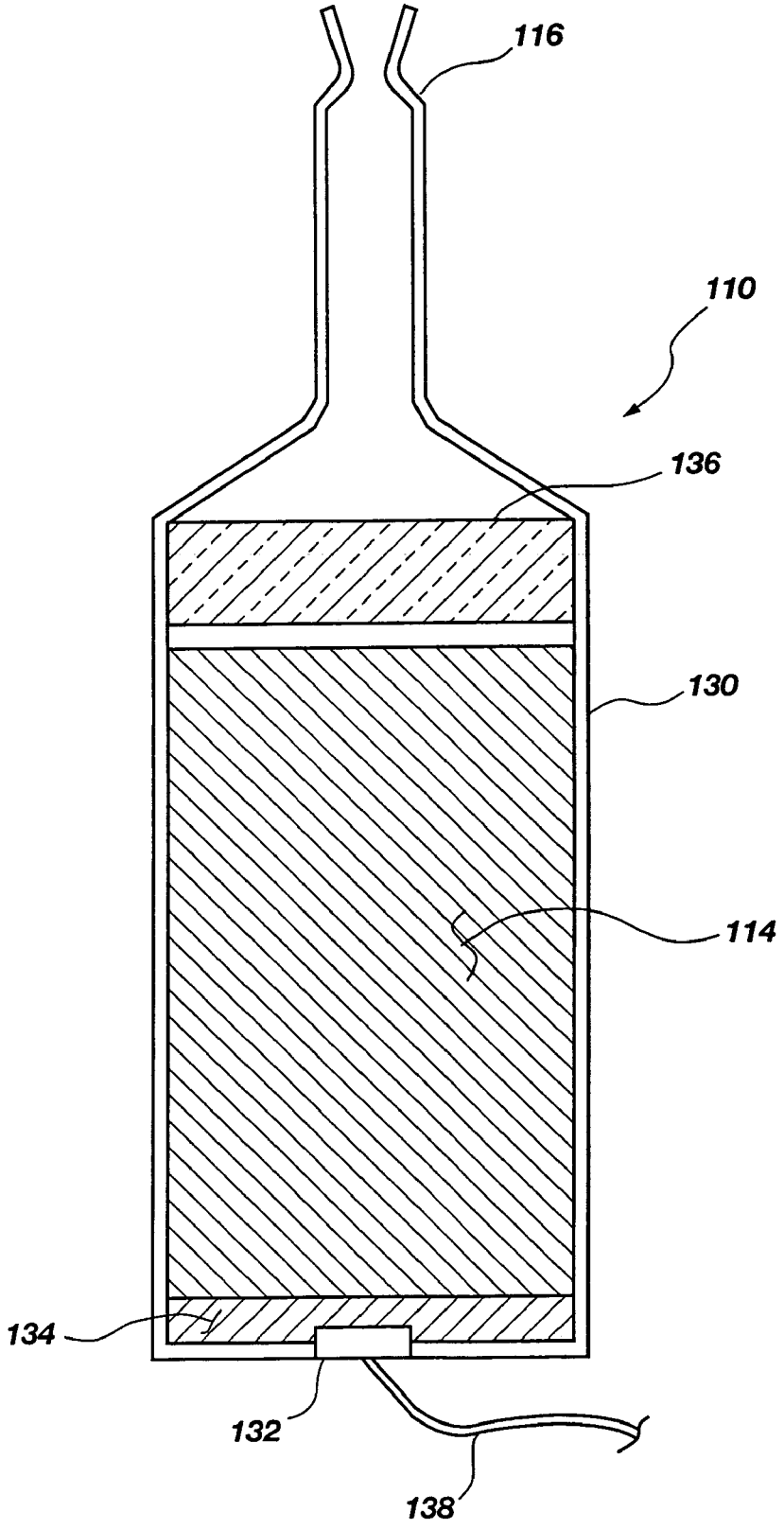
FIG. 2 is a partial cross-sectional view of a gas-generating device utilized in a fire suppression system in accordance with an embodiment of the present invention.

Referring now briefly to FIG. 2, a cross-sectional view of the gas-generating device 110 is shown in accordance with an embodiment of the present invention. The gas-generating device 110 includes a housing structure 130 containing a volume of propellant 114 therein. An ignition device 132 is located and configured to ignite the propellant 114 upon the occurrence of a particular event. The ignition device 132 may include, for example, a squib, a semiconductor bridge (SCB), or a wire configured to be heated to incandescence. In one embodiment, the ignition device 132 may be configured to directly ignite the propellant 114 without the aid of an igniting composition. In another embodiment, the ignition device 132 may be in contact with an igniting composition 134, which provides sufficient heat for the ignition of the propellant 114.

Depending on the specific composition being utilized, the igniting composition 134 may be configured to produce a hot gas upon ignition thereof wherein the hot gas provides sufficient heat for the subsequent ignition and combustion of the propellant 114. In another embodiment, the igniting composition 134 may be configured to produce a molten material, such as a metal slag, which is sufficiently hot to ignite and initiate combustion of the propellant 114.

Exemplary igniting compositions 134 may include those disclosed in U.S. Pat. No. 6,086,693, the disclosure of which patent is incorporated by reference herein. It is noted, however, that various igniting compositions may be utilized in the present invention depending, for example, on the composition of the propellant 114, the type of ignition device 132 being employed and the resulting gases that are desired to be produced (or eliminated) during operation of the gas-generating device 110.

Upon ignition of the propellant 114, a gas is generated that, in one embodiment, may include an inert gas suitable for introduction into a human-occupied space or for an environment that houses sensitive electronic equipment. For example, in one embodiment, the propellant 114 may include a composition that is configured to produce nitrogen gas, such as $N_2$, upon combustion thereof. In another embodiment, the propellant 114 may include a composition that is configured to produce $H_2O$ (water vapor), $CO_2$ (carbon dioxide) gases or various mixtures of such exemplary gases upon the combustion thereof. Various propellant compositions are contemplated as being used with the present invention. However, depending on various factors such as the intended normal use of the environment being protected by the fire suppression apparatus 100, it may be desirable to utilize a composition that produces a gas (or gas mixture) that is free of ozone-depleting gases (e.g., halogenated fluorocarbons) and/or global warming gases (e.g., carbon dioxide) while still being effective at lowering the oxygen content of air contained within a generally enclosed space.

In one embodiment, an exemplary propellant composition may include a HACN composition, such as disclosed in U.S. Pat. Nos. 5,439,537 and 6,039,820, both to Hinshaw et al., the disclosure of each of which patents is incorporated by reference herein. Of course other compositions may be utilized. In one embodiment, a propellant composition may be configured to produce an inert gas including nitrogen and water vapor.

In one example, it may be desirable to produce approximately 1.5 kilograms (kg) to approximately 300 kg of nitrogen gas from the propellant 114 contained within the gas-generating device 110. In producing such a mass of nitrogen, it may be desirable to produce less than 1% of carbon dioxide by volume with negligible amounts of carbon monoxide. Furthermore, it may be desirable to produce a gas which is substantially residue free so as to not leave a film or coating of residue on any equipment, furniture, etc., which may be located within the environment being protected by the apparatus.

The gas-generating device 110 may further include a filter 136 such as, for example, a screen mesh or an amount of steel shot disposed within the housing 130. The filter 136 may be used to prevent slag or molten material produced during combustion of the propellant 114 from leaving the housing 130. The prevention of slag or other solids from leaving the gas-generating device 110 may be desirable to prevent the blocking or clogging of the nozzle 116, to prevent damage to other components located within the flow path 108 (FIG. 1) and to simply prevent damage to equipment or injury to individuals that might otherwise result if such high-temperature materials were allowed to be discharged back into the environment being serviced by the fire suppression apparatus 100.

Referring to both FIGS. 1 and 2, operation of the fire suppression apparatus 100 is now described. Upon detection of a fire, the ignition device 132 may be actuated such as by providing an electrical signal through one or more conductors 138. The signal may be provided automatically through detection of a fire by an appropriate sensor, or may be the result of the manual actuation of a switch or similar device. The ignition device 132 is configured to ignite the propellant 114 within the gas-generating device 110, either directly or by way of an igniting composition 134 as set forth above.

The ignition and subsequent combustion of the propellant 114 results in the generation of a gas that flows through the nozzle 116 of the gas-generating device 110 as indicated by directional arrow 140. The nozzle 116 is configured to substantially control the flow of the generated gas including the velocity of the gas exiting the nozzle 116 as it enters into the flow path 108. In one embodiment, the nozzle 116 is configured such that gas exits the nozzle 116 at sonic or supersonic velocities. The high-velocity gas flow exiting the nozzle 116, combined with the geometric area ratios and the location of the nozzle 116 within the flow path 108 relative to the first set of openings 104, causes ambient air (i.e., air external to the fire suppression apparatus 100) to be drawn in through the first set of openings 104. In other words, the high-velocity production of gas effects an aspiration or eduction of ambient air located outside the fire suppression apparatus 100 through the first set of openings 104 and into the flow path 108 as indicated at 108A.

The ambient air drawn into the flow path 108 passes through the oxygen-getting device 120 which, through a chemical reaction, reduces the level of oxygen within the ambient air flowing therethrough. For example, the oxygen-getting device 120 may be at least partially formed of a material comprising iron which may adsorb approximately 0.4 pounds of oxygen per pound of material (lbs. oxygen/lb. mat'l). The iron material will react with the ambient air flowing through the oxygen-getting device 120 to reduce the oxygen content thereof and produce $Fe_3O_4$ within the oxygen-getting device 120. In another exemplary embodiment, the oxygen-getting device 120 may be at least partially formed of a material comprising copper which may adsorb approximately 0.25 lbs. oxygen/lb. mat'l. The reaction of the ambient air with the copper will result in the production of CuO within the oxygen-getting device 120.

In a further exemplary embodiment, the oxygen-getting device 120 may be at least partially formed of a material comprising nickel that may adsorb approximately 0.27 lbs. oxygen/lb. mat'l. The reaction of the ambient air with the nickel will result in the production of NiO within the oxygen-getting device 120. In yet another exemplary embodiment, the oxygen-getting device 120 may be at least partially formed of a material comprising titanium that may adsorb approximately 0.67 lbs. oxygen/lb. mat'l. The reaction of the ambient air with the titanium will result in the production of $TiO_2$ within the oxygen-getting device 120. Another exemplary material that may be used in the oxygen-getting device includes zirconium that may adsorb approximately 0.175 lbs. oxygen/lb. mat'l. It is noted, however, that the above materials are exemplary and that other materials may be used as well as other means and methods of extracting oxygen as will be appreciated by those of ordinary skill in the art.

As noted above, heat associated with the combustion of the propellant 114 may be transferred to the oxygen-getting device 120. For example, it is estimated that temperatures within the gas-generating device 110 may rise to between approximately 2500° F. and approximately 3500° F. in some embodiments. The transfer of heat away from the gas-generating device 110 provides the benefit of reducing potentially dangerous levels of heat and the dispersement of such heat over a larger area for effective cooling of the gas-generating device 110. Additionally, the transfer of heat to the oxygen-getting device 120 will also enhance the process of removing oxygen from any aspirated air passing therethrough by expediting the chemical reaction which takes place between the ambient air and the material disposed within the oxygen-getting device 120.

Figure 3A:
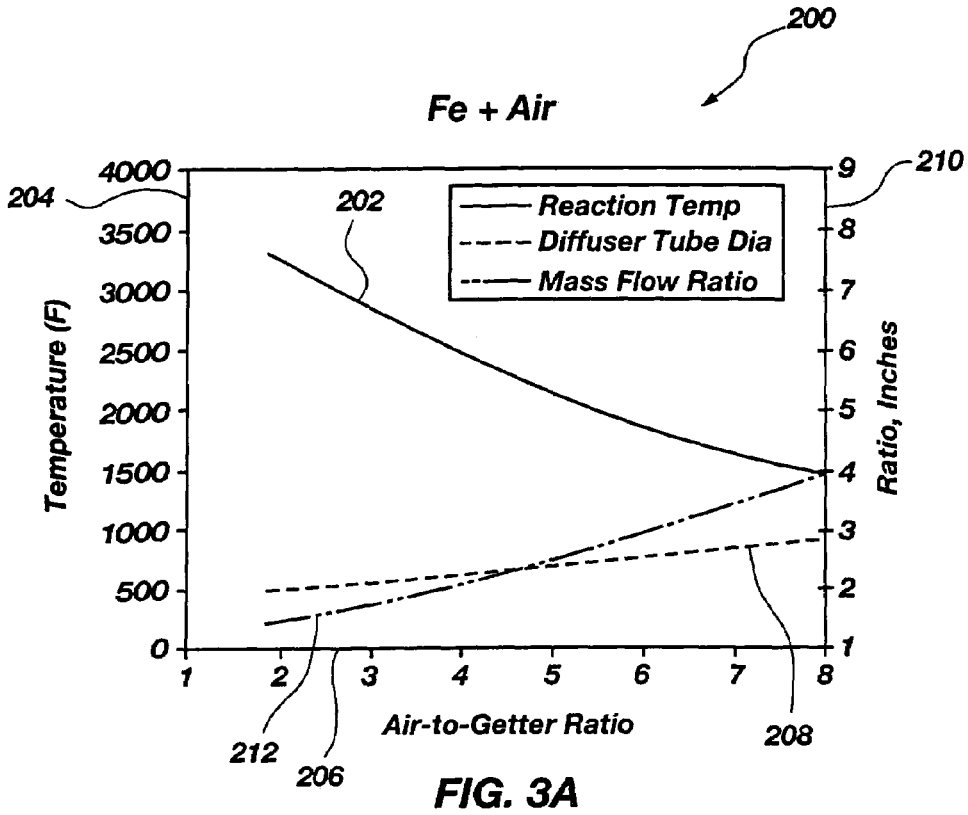
FIGS. 3A and 3B are plots of multiple variables associated with an oxygen-getting device in accordance with exemplary embodiments of the present invention.
Figure 3B:
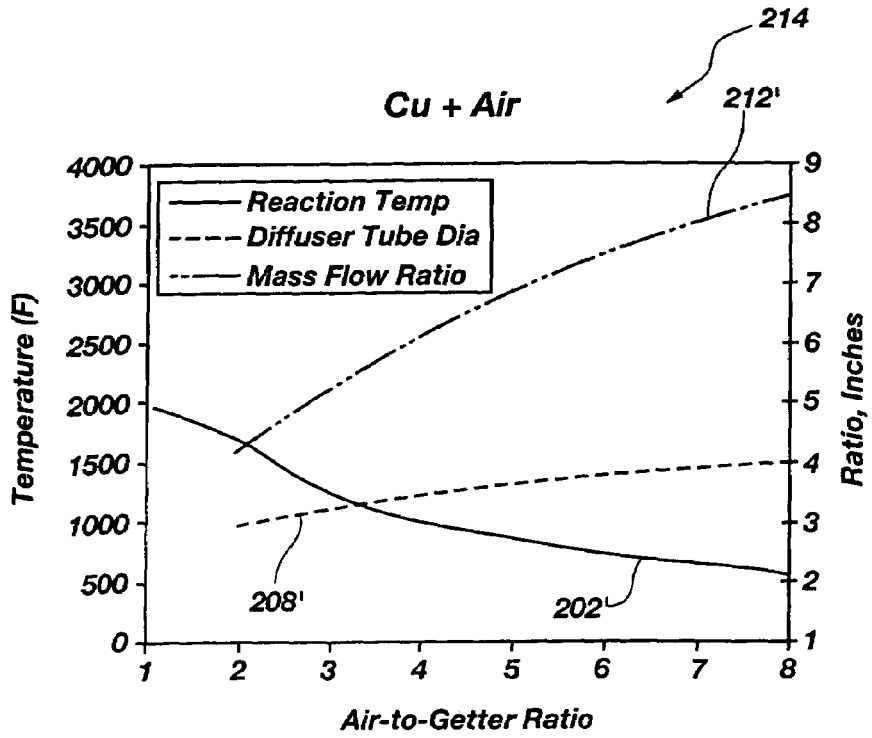
Figure 4:
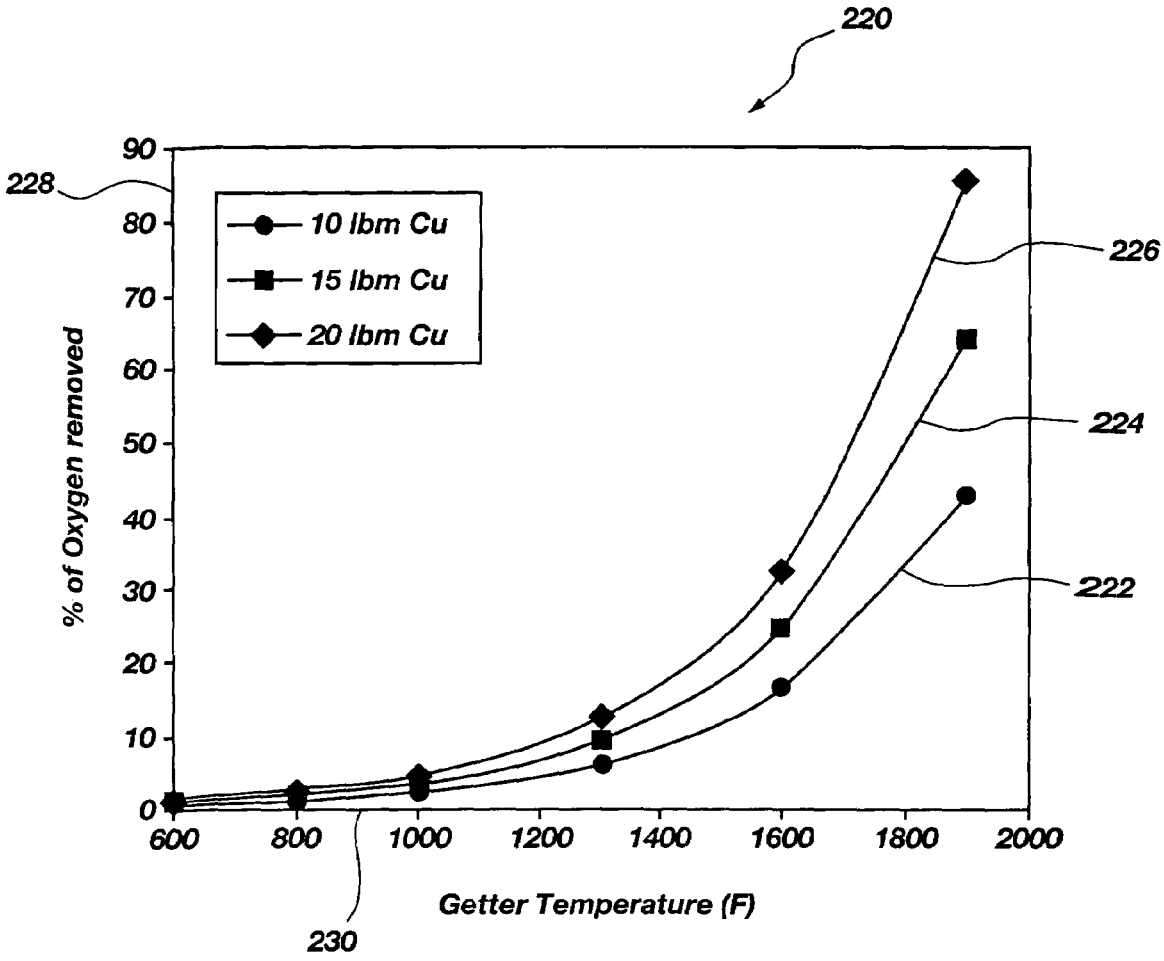
FIG. 4 is a plot of temperature vs. percent oxygen removed for specified exemplary embodiments of an oxygen-getting device.

Referring briefly to FIGS. 3A, 3B and 4 while still referring to FIGS. 1 and 2, it is shown how the operating temperature of the oxygen-getting device 120 may influence the performance of the fire suppression apparatus 100. FIG. 3A shows a first graph 200 depicting equilibrium reaction and aspirator relationships for an exemplary embodiment of a fire suppression apparatus 100 wherein iron (Fe) is used to react with air in an oxygen-getting device 120. More particularly, a first plotline 202 shows the relationship of temperature (left hand, vertical axis 204) with respect to the "air-to-getter ratio" (horizontal axis 206), which is defined as the pound-mass (lbm) ratio of aspirated air to the iron material present in the oxygen-getting device 120 in an equilibrium reaction (i.e., assuming complete reaction of the air with the iron material). A second plotline 208 shows the relationship of the air-to-getter ratio to the cross-sectional area of a given diffuser 118 (represented as a diffuser tube diameter in units of inches on the right hand, vertical axis 210). A third plotline 212 shows the relationship of the air-to-getter ratio with the mass flow ratio (also the right hand, vertical axis 210), which is the pound-mass ratio of aspirated air to combustion gas produced by the gas-generating device 110.

Referring briefly to FIG. 3B, a second graph 214 is shown for an exemplary embodiment wherein copper is used to react with air in an oxygen-getting device 120. Again, the first plotline 202 shows the relationship of temperature with the air-to-getter ratio; the second plotline 208 shows the relationship of the diffuser tube diameter with the air-to-getter ratio; and the third plotline 212 shows the relationship of the mass flow ratio with the air-to-getter ratio.

Referring now briefly to FIG. 4, a graph 220 includes three plotlines 222, 224 and 226 based on kinetic calculations of the percent oxygen removed from the aspirated air (left hand, vertical axis 228) for a stated temperature of the material present in the oxygen-getting device 120 (horizontal axis 230). For example, the first plotline 222 shows such a relationship for 10 lbm of copper, the second plotline 224 shows a similar relationship for 15 lbm of copper, and the third plotline 226 shows a similar relationship for 20 lbm of copper.

Considering the graphs 200, 214 and 220 together as shown in FIGS. 3A, 3B and 4, it can be seen that such relationships may be used to assist in selecting an oxygen-getting material for use in an oxygen-getting device 120. The graphs 200, 214 and 220 also show the importance of flow path geometry, such as the size of the diffuser 118, in regards to aspiration performance.

For example, after a material has been selected for use in the oxygen-getting device 120 based on information such as shown in FIG. 4, the further information provided in a corresponding graph (i.e., graph 214 in FIG. 3B) may be used to design other aspects of the fire suppression apparatus 100. Still using FIGS. 3B and 4 as an example, it is apparent that, when utilizing a copper material, the rate of oxygen removal from aspirated air increases as the temperature of the copper goes up. However, depending on the intended application and environment of the fire suppression apparatus 100, it may be desirable to keep the effluent gas mixture below a specified temperature. The temperature of the effluent gas mixture may be controlled by keeping the temperature of the combustion gas at or below a specified level or, as previously discussed, by providing a heat transfer device 126 to reduce the temperature of the gas mixture prior to its exit from the fire suppression apparatus 100. In either case, once the operating temperature of the oxygen-getting device 120 is established, the air-to-getter ratio may be determined and, subsequently, the mass flow ratio and the diffuser tube diameter may similarly be determined utilizing the graph 214 shown in FIG. 3B.

Referring more particularly to FIGS. 1 and 2 again, after the ambient air has passed through the oxygen-getting device 120, the now oxygen-depleted (or oxygen-reduced) air is drawn further into the flow path 108 and is mixed and entrained with the gas exiting the nozzle 116 of the gas-generating device 110 as indicated at 108B. The gas mixture (i.e., the generated gas exiting the nozzle 116 combined with the oxygen-depleted air) flows through a diffuser 118 that is configured to reduce the velocity of the gas mixture. The gas mixture flows through the diffuser 118 and through any subsequent processing apparatus placed in the flow path 108, as indicated at 108C, such as the second oxygen-getting device 123, the $NO_x$ scavenging device 124, the heat transfer device 126, a filter 136 or some other processing or conditioning device such as, for example, a $NH_3$ scavenger, as may be desired, to further condition the gas mixture or alter the flow characteristics thereof.

The gas mixture then exits the second set of openings 106, as indicated at 108D, at a reduced velocity. In some embodiments, it may be desirable to reduce the velocity of the gas mixture such that it exits the second set of openings 106 at a subsonic velocity. Additional components may be utilized within the flow path 108 to control the velocity of the gas mixture. For example, as shown in FIG. 1, the flow path 108 may include one or more bends or channels to redirect the flow of the gas mixture and reduce the velocity thereof. Additionally, baffles or other similar devices may be placed in the flow path 108 to control flow characteristics of the gas mixture. Additional diffusers 118 may also be utilized including, for example, at or adjacent the second set of openings 106 to further reduce the velocity of the gas mixture exiting the housing 102.

As the gas mixture exits the second set of openings 106, the gas mixture contains a volume of inert gas, such as nitrogen, configured to displace the oxygen contained with the air of a substantially enclosed environment. The gas mixture also includes an amount of oxygen-depleted air, which was initially drawn from the substantially enclosed environment, such that the overall level of oxygen available to support combustion is substantially reduced and, desirably, prevents further combustion of any fire which may be occurring within the environment serviced by the fire suppression apparatus 100.

Figure 5:
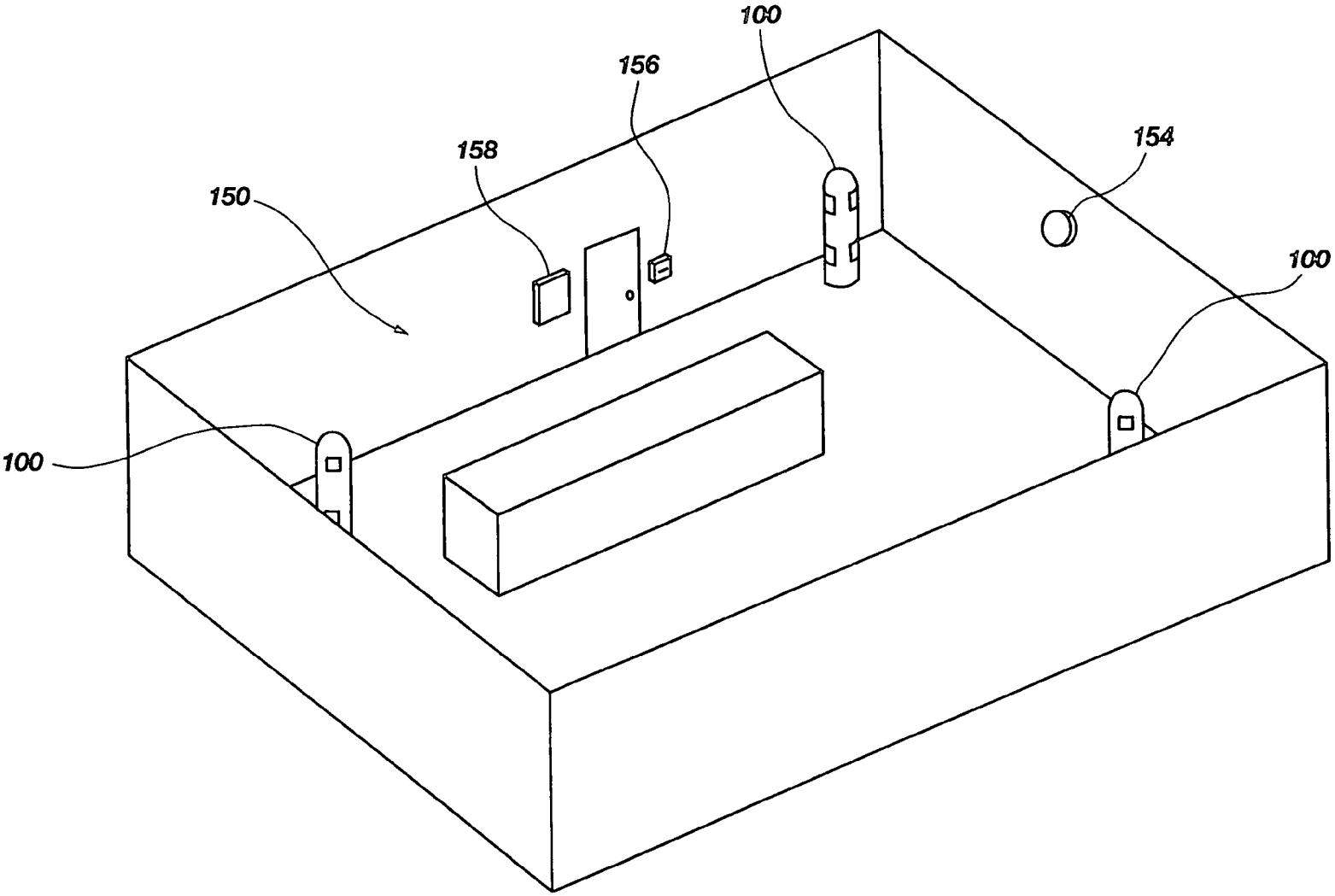
FIG. 5 is a perspective view of a fire suppression system installed in an environment for the protection thereof.
Figure 6:
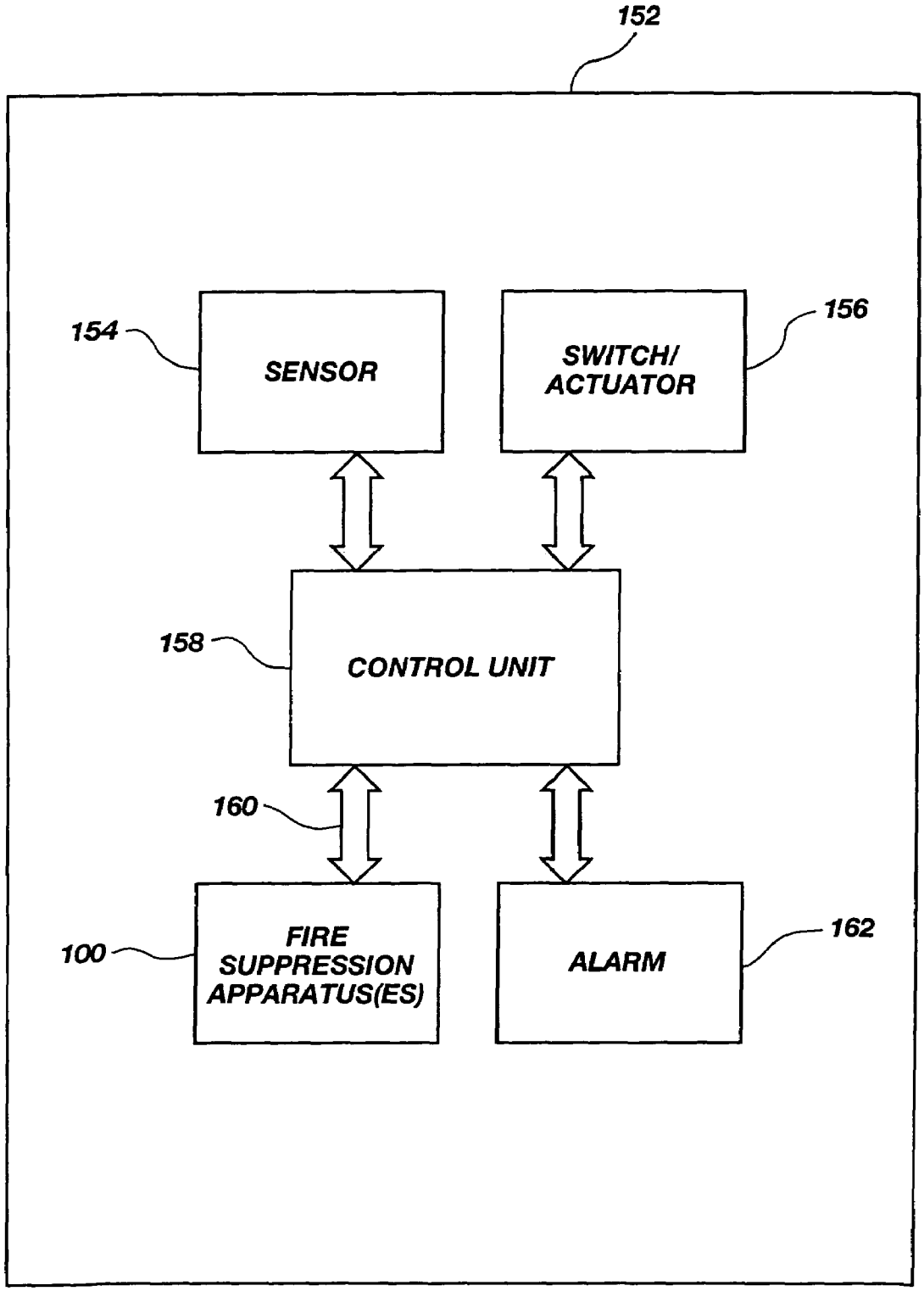
FIG. 6 is a schematic view of a fire suppression system in accordance with an embodiment of the present invention.

Referring now to FIGS. 5 and 6, FIG. 5 shows a perspective of a defined environment 150 in which one or more fire suppression apparatuses 100 of the present invention may be utilized, while FIG. 6 shows a schematic of a fire suppression system 152 that may incorporate one or more of the fire suppression apparatuses 100 and may be used to service the above-stated environment 150.

One or more of the fire suppression apparatuses 100 may be strategically located within the environment 150 to draw in air from the environment 150 and distribute a gas mixture, such as described hereinabove, back to the environment 150. The number of the fire suppression apparatuses 100 utilized and their specific location within the environment 150 may depend, for example, on the size of the environment 150 (e.g., the volume of air contained thereby), the intended use of the environment 150 (e.g., human-occupied, clean room, etc.), and/or the type of fire expected to be encountered within the environment 150.

The fire suppression system 152 may include one or more sensors 154 such as, for example, smoke sensors, heat sensors, or sensors that are configured to detect the presence of a particular type of gas. The system 152 may also include one or more actuators 156 that may be manually triggered by an occupant of the environment 150 upon the occurrence of a fire. The sensors 154 and actuators 156 may be operably coupled with a control unit 158 that may include, for example, a dedicated control unit or a computer programmed to receive input from or otherwise monitor the status of the sensors 154 and actuators 156 and, upon the occurrence of a predetermined event, actuate the gas-generating device 110 (FIGS. 1 and 2) and initiate the operation of the fire suppression apparatuses 100.

Thus, for example, upon the detection of smoke by a sensor 154, or upon the manual triggering of one of the actuators 156, an appropriate signal may be relayed to the control unit 158. The control unit 158 may then generate an appropriate signal which is relayed to the fire suppression apparatuses 100, thereby igniting the ignition device 132 (FIG. 2). As set forth above, the igniting device causes the propellant 114 (FIG. 2) to ignite and combust, generating gas and, ultimately, resulting in a gas mixture being distributed within the environment 150. The fire suppression system 152 may be configured to relay such signals through an appropriate transmission path 160 which may include, for example, conductors configured for either analog or digital transmission of such signals, or a wireless transmission path between the various devices. The fire suppression system 152 may further include an alarm 162 which may also be actuated by the control unit 158. Such an alarm 162 may include a device configured to provide a visual indicator, an auditory indicator, or both to any occupants of the environment 150.

Figure 7A:
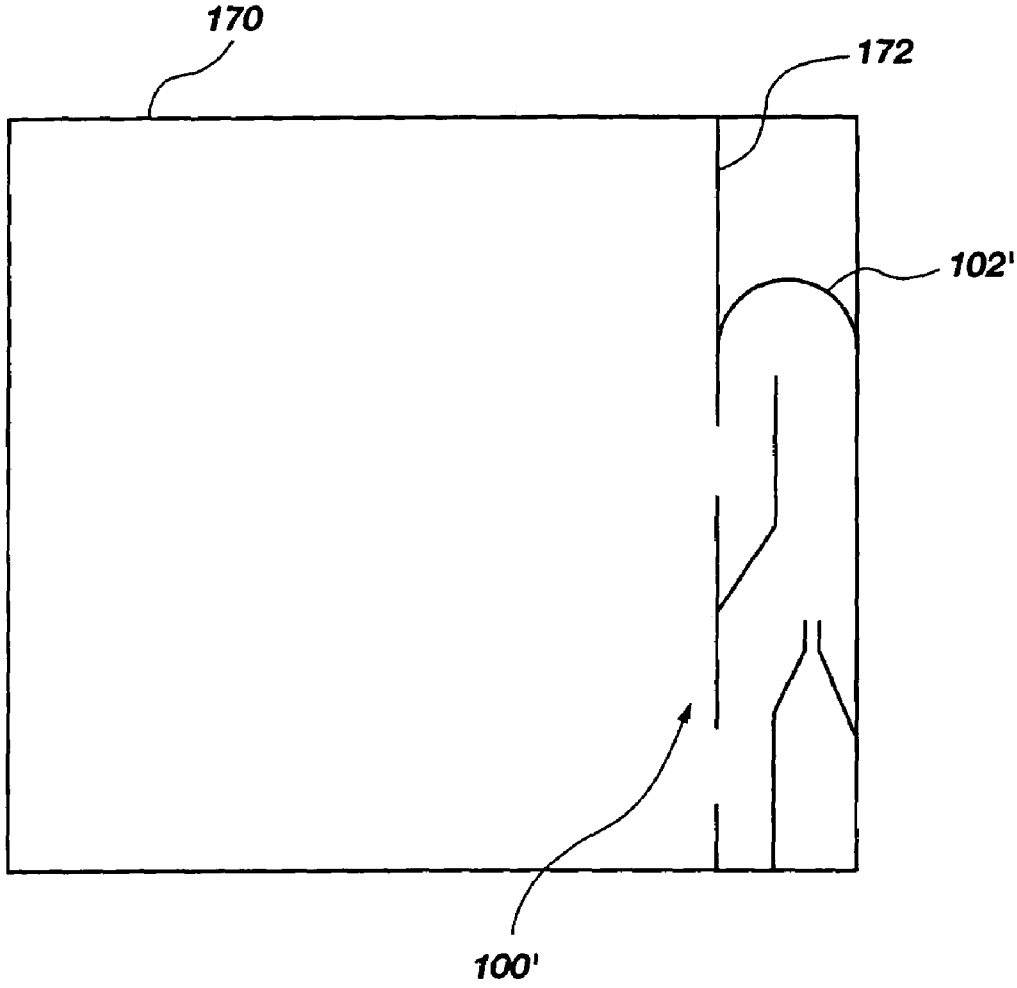
FIGS. 7A and 7B show schematic and partial cross-sectional views, respectively, of a fire suppression apparatus in accordance with an embodiment of the present invention.
Figure 7B:
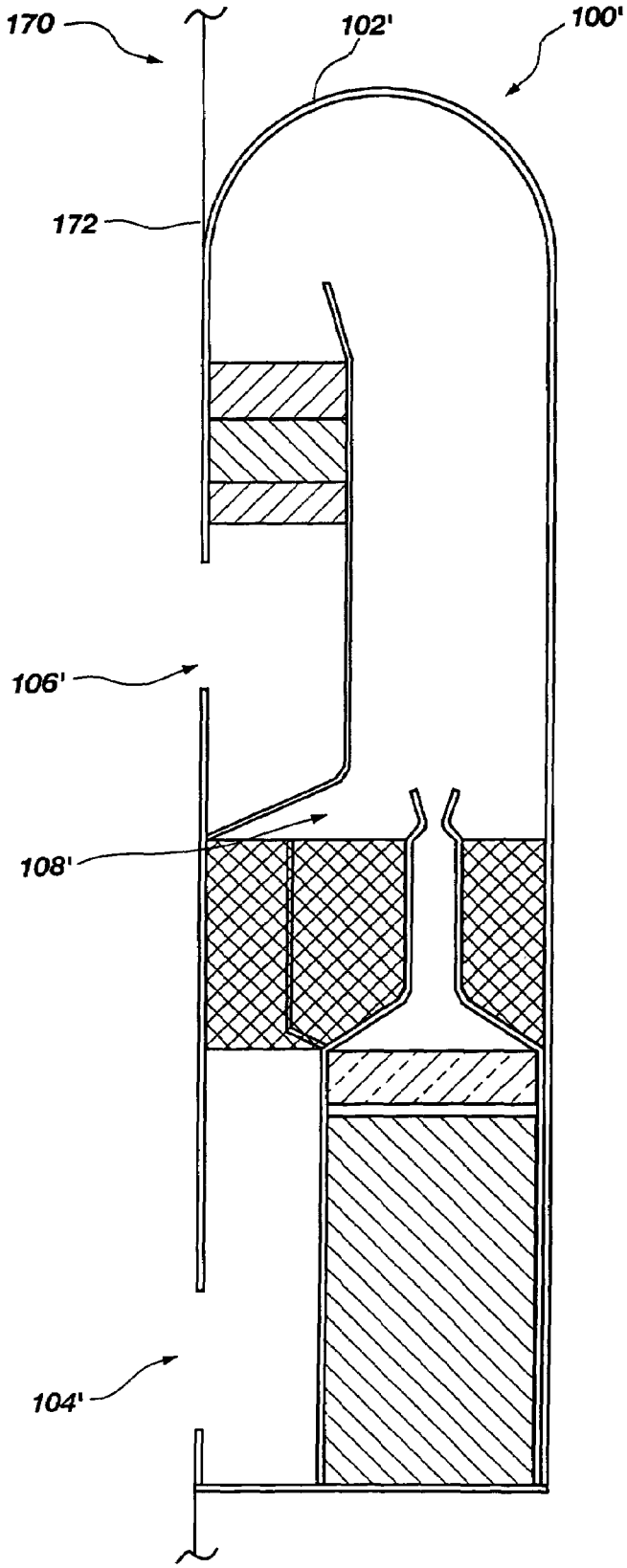

Referring now to FIGS. 7A and 7B, another embodiment of a fire suppression apparatus 100' is shown. The fire suppression apparatus 100' is constructed similarly to that which is shown and described with respect to FIGS. 1 and 2, except that the fire suppression apparatus 100' is configured and located so as to be substantially integrated with a structure 170 associated with the environment being serviced or protected thereby. Thus, the structure 170 may be integral with the housing 102' of the fire suppression apparatus 100' wherein a first opening 104' (or set of openings) is formed within a wall or panel 172 of the structure 170, a second opening 106' (or set of openings) is formed within the wall 172 of the structure 170, and a flow path 108' is defined between the first and second openings 104' and 106', respectively.

Various processing devices may be placed in the flow path 108' including, for example, oxygen-getting devices, $NO_x$ scavengers, filters and/or heat transfer devices such as described above. Additionally, various flow control devices, such as diffusers, baffles or redirected flow paths, may be incorporated into the fire suppression apparatus 100' to control the flow of the gas mixture that ultimately exits the second opening 106'.

The structure 170 into which the fire suppression apparatus 100 is integrated may include a room of a building or the cabin of a land, sea or air vehicle such as, for example, an automobile, a train car, a plane or some other vehicle. For example, the structure 170 may include an automobile and the wall or panel 172 may include a portion of the dashboard or a side panel associated with a door. Thus, the fire suppression apparatus 100 may be located in various strategic locations in numerous types of environments.

Figure 8:
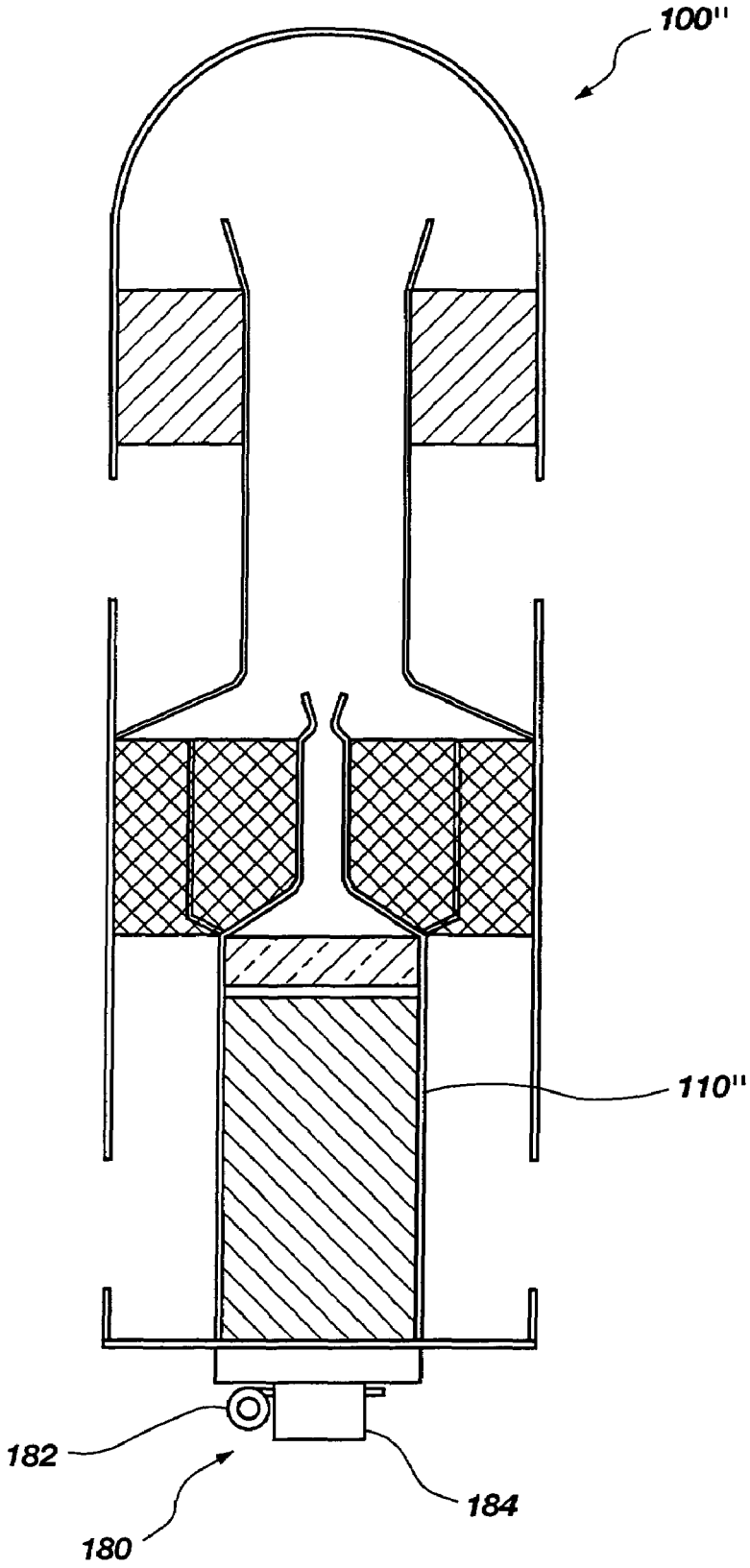
FIG. 8 is a partial cross-sectional view of a fire suppression apparatus in accordance with yet another embodiment of the present invention.

Referring briefly to FIG. 8, a partial cross-sectional view of a fire suppression apparatus 100''' is shown in accordance with another embodiment of the present invention. The fire suppression apparatus 100''' is similar to those described above but is configured to be portable such that it may be actuated and quickly disposed within a selected environment. Thus, for example, a manually deployed actuator 180 may be configured to actuate any igniting device associated with the gas-generating device 110'''. In operation, a user may deploy the actuator 180 by, for example, pulling a safety pin 182 and pressing a button or other mechanical device 184, thereby actuating an igniting device and combusting propellant contained within the gas-generating device 110'''. A timer or other delay mechanism may also be incorporated with the actuator 180 so that actuation of the associated igniting device and combustion of the propellant contained within the gas-generating device 110''' does not occur for a predetermined length of time. Such a delay mechanism may allow users to actuate the fire suppression apparatus 100''' and then distance themselves therefrom so as to avoid contact with the fire suppression apparatus 100''' in cases where the heat of the fire suppression apparatus 100''' or gases generated thereby may pose a threat when a user is in extremely close proximity therewith.

Thus, in operation, a user may be able to deploy the actuator 180, dispose of the fire suppression apparatus 100 in an identified environment (e.g., in a room of a building, the cabin of an automobile or other vehicle, etc.) and, if necessary, remove themselves from the fire suppression apparatus 100 to a remote location prior to the ignition and operation thereof.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A fire suppression apparatus comprising:

a housing defining a first opening therein, a second opening therein and a flow path providing fluid communication between the first opening and the second opening;

a gas-generating device located and configured to provide a flow of a first gas into the flow path such that the flow of the first gas draws a volume of ambient air from a location outside the housing, through the first opening and into the flow path; and at least one oxygen-getting device disposed in the flow path, wherein the oxygen-getting device is configured to reduce a level of oxygen in the volume of ambient air as it flows therethrough.

2. The fire suppression apparatus of claim 1, wherein the gas-generating device further includes a nozzle through which the first gas flows into the flow path.

3. The fire suppression apparatus of claim 2, wherein the nozzle is configured to accelerate the flow of the first gas to a supersonic velocity.

4. The fire suppression apparatus of claim 2, wherein the nozzle is configured to accelerate the flow of the first gas to a substantially sonic velocity.

5. The fire suppression apparatus of claim 2, wherein the gas-generating device further includes a solid propellant composition configured to generate the first gas upon combustion thereof.

6. The fire suppression apparatus of claim 5, wherein the solid propellant composition is configured to generate the first gas as an inert gas.

7. The fire suppression apparatus of claim 5, wherein the solid propellant composition is configured to generate a volume of at least one of $N_2$, $H_2O$ and $CO_2$ as the first gas.

8. The fire suppression apparatus of claim 5, further comprising an igniting device configured to ignite the solid propellant composition.

9. The fire suppression apparatus of claim 8, wherein the igniting device includes at least one of a squib, a semiconductor bridge and a conductive wire.

10. The fire suppression apparatus of claim 8, further comprising an igniting composition in contact with the igniting device.

11. The fire suppression apparatus of claim 10, wherein the igniting composition is configured to produce a volume of hot gas upon ignition thereof.

12. The fire suppression apparatus of claim 10, wherein the igniting composition is configured to produce a mass of heated slag upon ignition thereof.

13. The fire suppression apparatus of claim 10, wherein the gas-generating device further includes a filter disposed between the solid propellant composition and the nozzle.

14. The fire suppression apparatus of claim 13, wherein the filter comprises at least one of screen mesh and shot material.

15. The fire suppression apparatus of claim 2, further comprising a diffuser disposed within the flow path located and configured to alter a velocity of the first gas and to effect mixing of the first gas with the volume of ambient air drawn into the flow path and thereby form a gas mixture.

16. The fire suppression apparatus of claim 15, further comprising at least one conditioning apparatus disposed within the flow path.

17. The fire suppression apparatus of claim 16, wherein the at least one oxygen-getting device is disposed between the first opening and the diffuser.

18. The fire suppression apparatus of claim 16, wherein the at least one conditioning apparatus includes an $NO_X$ scavenger disposed between the diffuser and the second opening.

19. The fire suppression apparatus of claim 16, wherein the at least one conditioning apparatus includes a filter disposed between the diffuser and the second opening.

20. The fire suppression apparatus of claim 16, wherein the at least one conditioning apparatus is configured to be removed from the housing and replaced with another conditioning apparatus.

21. The fire suppression apparatus of claim 1, wherein the at least one oxygen-getting device includes an oxygen reactive material.

22. The fire suppression apparatus of claim 21, wherein the oxygen reactive material includes at least one of iron, nickel, copper, zirconium and titanium.

23. The fire suppression apparatus of claim 1, wherein the at least one oxygen-getting device is thermally coupled to the nozzle.

24. The fire suppression apparatus of claim 1, further comprising a plurality of thermally conductive fins coupled with the gas-generating device.

25. The fire suppression apparatus of claim 24, wherein the plurality of thermally conductive fins is coupled with the nozzle of the gas-generating device.

26. The fire suppression apparatus of claim 25, wherein the plurality of thermally conductive fins is also coupled with the at least one oxygen-getting device.

27. The fire suppression apparatus of claim 1, wherein the at least one oxygen-getting device is disposed between the diffuser and the second opening.

28. The fire suppression apparatus of claim 1, wherein the first opening includes a first plurality of openings and wherein the second opening includes a second plurality of openings.

29. The fire suppression apparatus of claim 28, wherein the housing is formed of a metallic material.

30. The fire suppression apparatus of claim 29, wherein the housing is formed of a material comprising steel.

31. The fire suppression apparatus of claim 1, wherein the gas-generating device is configured to be removed from the housing and replaced with another gas-generating device.

32. The fire suppression apparatus of claim 1, wherein the housing is substantially integral with a structure associated with an environment intended to be protected by the fire suppression apparatus.

33. The fire suppression apparatus of claim 32, wherein the structure includes a room of a building.

34. The fire suppression apparatus of claim 32, wherein the structure includes a cabin of a vehicle.

35. A fire suppression apparatus comprising:

a housing defining a first opening therein, a second opening therein and a flow path providing fluid communication between the first opening and the second opening;

a gas-generating device located and configured to provide a flow of a gas into the flow path such that the flow of the gas draws a volume of ambient air from a location outside the housing, through the first opening and into the flow path, the gas-generating device including a nozzle through which the gas flows into the flow path;

a diffuser disposed within the flow path located and configured to alter a velocity of the first gas and to effect mixing of the gas with the volume of ambient air drawn into the flow path and thereby form a gas mixture; and at least one conditioning apparatus disposed within the flow path wherein the at least one conditioning apparatus includes a heat transfer device disposed between the diffuser and the second opening.

36. A fire suppression system comprising:

at least one fire suppression apparatus comprising:

a housing defining a first opening therein, a second opening therein and a flow path providing fluid communication between the first opening and the second opening;

a gas-generating device located and configured to provide a flow of a first gas into the flow path such that the flow of the first gas draws a volume of ambient air from a location outside the housing, through the first opening and into the flow path;

at least one oxygen-getting device disposed in the flow path, wherein the oxygen-getting device is configured to reduce a level of oxygen in the volume of ambient air as it flows therethrough; and a controller configured to generate a signal and transmit the signal to the at least one fire suppression apparatus upon the occurrence of a specified event, wherein the gas-generating device is configured to provide the flow of the first gas upon receipt of the signal from the controller.

37. The fire suppression system of claim 36, further comprising at least one sensor configured to generate and transmit a sensor signal to the controller.

38. The fire suppression system of claim 37, wherein the at least one sensor further comprises at least one of a smoke detector and a temperature sensor.

39. The fire suppression system of claim 37, wherein the at least one sensor is configured to detect the presence of a specified gas.

40. The fire suppression system of claim 36, further comprising at least one actuator configured to generate and transmit an actuator signal to the controller.

41. The fire suppression system of claim 36, further comprising at least one alarm device located and configured to receive a signal generated by an alarm and provide an alarm indicator.

42. The fire suppression system of claim 41, wherein the at least one alarm device is configured to provide at least one of a visual indicator and an auditory indicator as the alarm indicator.

43. The fire suppression system of claim 36, wherein the gas-generating device further includes a nozzle through which the first gas flows into the flow path.

44. The fire suppression system of claim 43, wherein the nozzle is configured to accelerate the flow of the first gas to a supersonic velocity.

45. The fire suppression system of claim 43, wherein the nozzle is configured to accelerate the flow of the first gas to a substantially sonic velocity.

46. The fire suppression system of claim 43, wherein the gas-generating device further includes a solid propellant composition configured to generate the first gas upon combustion thereof.

47. The fire suppression system of claim 46, further comprising an igniting device configured to ignite the solid propellant composition.

48. The fire suppression system of claim 47, further comprising an igniting composition in contact with the igniting device.

49. The fire suppression system of claim 48, wherein the igniting composition is configured to produce a volume of hot gas upon ignition thereof.

50. The fire suppression system of claim 48, wherein the igniting composition is configured to produce a mass of heated slag upon ignition thereof.

51. The fire suppression system of claim 48, wherein the gas-generating device further includes a filter disposed between the solid propellant composition and the nozzle.

52. The fire suppression system of claim 43, further comprising a diffuser disposed within the flow path located and configured to alter a velocity of the first gas and to effect mixing of the first gas with the volume of ambient air drawn into the flow path and thereby form a gas mixture.

53. The fire suppression system of claim 52, further comprising at least one conditioning apparatus disposed within the flow path.

54. The fire suppression system of claim 53, wherein the at least one conditioning apparatus includes at least one of an $NO_X$ scavenger and a $NH_3$ scavenger disposed between the diffuser and the second opening.

55. The fire suppression system of claim 53, wherein the at least one conditioning apparatus includes a filter disposed between the diffuser and the second opening.

56. The fire suppression system of claim 53, wherein the at least one conditioning apparatus is configured to be removed from the housing and replaced with another conditioning apparatus.

57. The fire suppression system of claim 52, wherein the at least one oxygen-getting device is disposed between the first opening and the diffuser.

58. The fire suppression system of claim 36, wherein the oxygen-getting device includes an oxygen reactive material.

59. The fire suppression system of claim 58, wherein the oxygen reactive material includes at least one of iron, nickel, copper, zirconium and titanium.

60. The fire suppression system of claim 36, wherein the at least one oxygen-getting device is thermally coupled to the nozzle.

61. The fire suppression system of claim 52, wherein the at least one oxygen-getting device is disposed between the diffuser and the second opening.

62. The fire suppression system of claim 36, wherein the first opening includes a first plurality of openings and wherein the second opening includes a second plurality of openings.

63. A fire suppression system comprising:

at least one fire suppression apparatus comprising:

a housing defining a first opening therein, a second opening therein and a flow path providing fluid communication between the first opening and the second opening;

a gas-generating device located and configured to provide a flow of a gas into the flow path such that the flow of the gas draws a volume of ambient air from a location outside the housing, through the first opening and into the flow path, wherein the gas-generating device further includes a nozzle through which the first gas flows into the flow path;

a diffuser disposed within the flow path located and configured to alter a velocity of the gas and to effect mixing of the gas with the volume of ambient air drawn into the flow path and thereby form a gas mixture; and at least one conditioning apparatus disposed within the flow path wherein the at least one conditioning apparatus includes a heat transfer device disposed between the diffuser and the second opening; and a controller configured to generate a signal and transmit the signal to the at least one fire suppression apparatus upon the occurrence of a specified event, wherein the gas-generating device is configured to provide the flow of the gas upon receipt of the signal from the controller.

64. A fire suppression apparatus comprising:

a housing defining a first opening therein, a second opening therein and a flow path providing fluid communication between the first opening and the second opening;

a gas-generating device including a solid propellant composition disposed within a housing, wherein the solid propellant composition is configured to produce a gas upon combustion thereof;

an igniting device configured to ignite the solid propellant composition;

a nozzle coupled with the gas-generating device, wherein the nozzle is located and configured such that the gas flows through the nozzle into the flow path and also draws a volume of ambient air from a location outside the housing, through the first opening and into the flow path;

a filter disposed between the solid propellant composition and the nozzle;

a diffuser disposed within the flow path located and configured to alter a velocity of the gas and to effect mixing of the gas with the volume of ambient air drawn into the flow path and thereby form a gas mixture; and at least one conditioning apparatus disposed within the flow path including at least one oxygen-getting device configured to reduce a level of oxygen from the volume of ambient air.

65. The fire suppression apparatus of claim 64, wherein the first opening further comprises a first set of openings and wherein the second opening further comprises a second set of openings.

66. The fire suppression apparatus of claim 64, wherein the at least one oxygen-getting device is thermally coupled with the nozzle.

67. A method of suppressing fires, the method comprising:

providing a housing with a first opening and a second opening;

defining a flow path between the first opening and the second opening;

producing a fire-suppressing gas;

introducing the fire-suppressing gas into the flow path;

aspirating a volume of ambient air from a location external of the housing through the first opening and into the flow path;

mixing the volume of ambient air with the fire-suppressing gas to produce a gas mixture;

reducing a level of oxygen contained within the volume of ambient air including flowing the volume of ambient air over an oxygen reactive material; and discharging the gas mixture through the second opening.

68. The method according to claim 67, wherein producing a fire-suppressing gas includes producing an inert gas.

69. The method according to claim 67, wherein producing a fire-suppressing gas includes producing a gas comprising at least one of $N_2$, $H_2O$ and $CO_2$.

70. The method according to claim 67, wherein producing a fire-suppressing gas includes combusting a solid propellant composition.

71. The method according to claim 70, wherein combusting a solid propellant composition further includes igniting a second solid composition.

72. The method according to claim 71, wherein igniting a second solid composition includes producing a heated gas from the second solid composition.

73. The method according to claim 71, wherein igniting a second solid composition includes producing a molten slag from the second solid composition.

74. The method according to claim 67, wherein introducing the fire-suppressing gas into the flow path further includes introducing the fire-suppressing gas into the flow path at a supersonic velocity.

75. The method according to claim 67, wherein introducing the fire-suppressing gas into the flow path further includes introducing the fire-suppressing gas into the flow path at a substantially sonic velocity.

76. The method according to claim 67, wherein discharging the gas mixture through the second opening includes discharging the gas mixture at a subsonic velocity.

77. The method according to claim 68, wherein flowing the volume of ambient air over an oxygen reactive material further comprises flowing the volume of ambient air over a material comprising at least one of iron, copper, nickel, zirconium and titanium.

78. The method according to claim 67, further comprising heating the oxygen reactive material.

79. The method according to claim 78, wherein heating the oxygen reactive material further comprises thermally coupling the oxygen reactive material with a nozzle associated with introducing the fire-suppressing gas into the flow path.

80. The method according to claim 67, further comprising reducing a velocity of the fire-suppressing gas after it is introduced into the flow path and prior to discharging the gas mixture through the second opening.

81. The method according to claim 80, wherein reducing a velocity of the fire-suppressing gas further includes flowing the fire-suppressing gas through a diffuser.

82. The method according to claim 67, further comprising flowing the gas mixture through a conditioning device.

83. The method according to claim 82, wherein flowing the gas mixture through a conditioning device further comprises flowing the gas mixture through at least one of an $NO_x$ and an $NH_3$ scavenger.

84. The method according to claim 82, wherein flowing the gas mixture through a conditioning device further comprises flowing the gas mixture through a filter.

85. The method according to claim 67, wherein providing a housing with a first opening and a second opening further comprises providing a housing with a first set of openings and a second set of openings.

86. A method of suppressing fires, the method comprising:

providing a housing with a first opening and a second opening;

defining a flow path between the first opening and the second opening;

producing a fire-suppressing gas;

introducing the fire-suppressing gas into the flow path;

aspirating a volume of ambient air from a location external of the housing through the first opening and into the flow path;

mixing the volume of ambient air with the fire-suppressing gas to produce a gas mixture;

flowing the gas mixture through a conditioning device, wherein flowing the gas mixture through a conditioning device further comprises flowing the gas mixture through an oxygen-getting device; and discharging the gas mixture through the second opening.

87. A method of suppressing fires, the method comprising:

providing a housing with a first opening and a second opening;

defining a flow path between the first opening and the second opening;

producing a fire-suppressing gas;

introducing the fire-suppressing gas into the flow path;

aspirating a volume of ambient air from a location external of the housing through the first opening and into the flow path;

mixing the volume of ambient air with the fire-suppressing gas to produce a gas mixture;

flowing the gas mixture through a conditioning device, wherein flowing the gas mixture through a conditioning device further comprises flowing the gas mixture through a heat transfer device; and discharging the gas mixture through the second opening.

* * * * *